US009402124B2

(12) United States Patent
Zhang

(10) Patent No.: US 9,402,124 B2
(45) Date of Patent: Jul. 26, 2016

(54) METHOD FOR CONTROLLING TERMINAL DEVICE AND THE SMART TERMINAL DEVICE THEREOF

(71) Applicant: Xiaomi Inc., Beijing (CN)

(72) Inventor: Xu Zhang, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 111 days.

(21) Appl. No.: 14/162,788

(22) Filed: Jan. 24, 2014

(65) Prior Publication Data

US 2014/0314247 A1 Oct. 23, 2014

Related U.S. Application Data

(63) Continuation-in-part of application No. PCT/CN2013/085942, filed on Oct. 25, 2013.

(30) Foreign Application Priority Data

Apr. 18, 2013 (CN) ..... 2013 1 0136307

(51) Int. Cl.
*H04R 1/10* (2006.01)

(52) U.S. Cl.
CPC ..... *H04R 1/1041* (2013.01)

(58) Field of Classification Search
CPC ..... H04R 5/33; H04R 1/1041
USPC ..... 381/74, 58, 370–371, 374, 376
See application file for complete search history.

(56) References Cited

U.S. PATENT DOCUMENTS 6,704,428 B1 * 3/2004 Wurtz ..... G10K 11/1788 381/370
7,418,103 B2 * 8/2008 Sargaison ..... H04M 1/6058 381/370

(Continued)

FOREIGN PATENT DOCUMENTS

CN 101211650 A 7/2008
CN 102104388 A 6/2011

(Continued)

OTHER PUBLICATIONS

"International Search Report for PCT/CN2013/085942".

(Continued)

*Primary Examiner* — Disler Paul
(74) *Attorney, Agent, or Firm* — Jun He Law Offices P.C.; James J. Zhu

(57) ABSTRACT

The embodiments of the present disclosure provide a method for controlling a smart terminal device and the smart terminal device thereof. The method comprises: monitoring a wearing state of receivers of an earphone connected to the smart terminal device, wherein the wearing state comprises a putting-on state and a taking-off state; and controlling running state of one or more applications in the smart terminal device and/or an operation mode of the smart terminal device according to the wearing state of the receivers. The embodiments of the present disclosure can simplify manual operations by monitoring the change of wearing state of an earphone. The lifetime of the mechanical members of the earphone can be improved, the electric energy of the smart terminal device can be saved, and no manual operation control is needed.

11 Claims, 4 Drawing Sheets

(56) References Cited

U.S. PATENT DOCUMENTS

| | | | | |
|---|---|---|---|---|
| 2006/0029234 | A1* | 2/2006 | Sargaison | H04M 1/6058 381/74 |
| 2009/0180639 | A1* | 7/2009 | Dai | A61B 5/6817 381/74 |
| 2010/0020998 | A1* | 1/2010 | Brown | H04R 1/1041 381/380 |
| 2013/0101140 | A1* | 4/2013 | Cho | H03G 3/3005 381/109 |

FOREIGN PATENT DOCUMENTS

| | | | |
|---|---|---|---|
| CN | 202034054 | U | 11/2011 |
| CN | 103024193 | A | 4/2013 |
| CN | 103257873 | A | 8/2013 |
| KR | 20130014752 | A | 2/2013 |

OTHER PUBLICATIONS

Apple to Add Presence Sensors to EarPods & Future Beats Headsets.

* cited by examiner

METHOD FOR CONTROLLING TERMINAL DEVICE AND THE SMART TERMINAL DEVICE THEREOF

CROSS REFERENCE TO RELATED APPLICATIONS

The present application is a Continuation-In-Part application of International Application NO. PCT/CN2013/085942, filed on Oct. 25, 2013, which is based upon and claims priority of Chinese Patent Application No. 201310136307.X, filed on Apr. 18, 2013, the entire contents of which are incorporated herein by reference.

TECHNICAL FIELD

The present disclosure generally relates to terminal device technology, and more particularly, to a method for controlling a smart terminal device and the smart terminal device thereof.

BACKGROUND

Smart terminal devices are terminal devices with multimedia functions, which can support audio-function, video-function, data processing function, or the like. For example, visual telephones, conference terminals, Personal Computers (PCs) with built-in multimedia function, Personal Digital Assistants (PDAs), etc. all belong to the smart terminal device.

With rapid populating of the smart terminal devices, the devices can bring more perfect video-audio experience, and thus become important recreational devices when a user is traveling.

In the case of mobile application, the user generally listens to the multimedia content by wearing an earphone. For example, the earphone is used when the smart terminal device is playing audio, video or a game. Moreover, with the development of the audio and video communication based on the mobile Internet, the earphone is often used during the audio or video communication.

However, in some emergency cases, the user generally takes off the worn earphone in a hurry so he may forget or have no time to stop playing the multimedia content, which may lead to a mistake in playing audio, video or game and waste of electric energy. If the user wants to stop playing the multimedia, he needs to get back to an operation interface of the smart terminal so that the user can press a pause button. For example, for a wired earphone, it is required to either press a physical pause button in the control wire, or directly unplug the earphone from the terminal device to pause the playing; and for a wireless earphone, it is required to press a switch on the earphone or a pause button in the player interface.

In addition, in some emergency cases, it is required for the user to switch among an earphone mode, a speaker mode and a hand-free mode during the audio communication and the video communication. However, the mode switching also requires manual plug/unplug of the wired earphone plug or manual connection/disconnection of the wireless earphone.

SUMMARY

The embodiments of the present disclosure provide a method for controlling a smart terminal device and the smart terminal device thereof, which can simplify operations caused by the change of the wearing state of an earphone, increase the lifetime of mechanical components of the earphone, and save electric energy of the smart terminal device.

According to a first aspect of the present disclosure, there is provided a method for controlling a smart terminal device, which may include: monitoring a wearing state of receivers of an earphone connected to the smart terminal device, wherein the wearing state comprises a putting-on state and a taking-off state; and controlling a running state of an application in the smart terminal device and/or an operation mode of the smart terminal device according to the wearing state of the receivers.

According to a second aspect of the present disclosure, there is provided a smart terminal device, which may include: one or more processors; and a memory configured to store one or more programs for execution by the one or more processors; wherein the one or more programs comprise instructions for: monitoring a wearing state of receivers of an earphone connected to the smart terminal device, wherein the wearing state comprises a putting-on state and a taking-off state; and controlling running state of one or more applications in the smart terminal device and/or an operation mode of the smart terminal device according to the wearing state of the receivers.

According to a third aspect of the present disclosure, there is provided a non-transitory computer-readable medium having stored therein instructions that, when executed by a processor of a smart terminal device, causes the smart terminal device to perform: monitoring a wearing state of receivers of an earphone connected to the smart terminal device, wherein the wearing state comprises a putting-on state and a taking-off state; and controlling running state of one or more applications in the smart terminal device and/or an operation mode of the smart terminal device according to the wearing state of the receivers.

The embodiments of the present disclosure may at least include the following advantages.

The wearing state of receivers of the earphone connected to the smart terminal device may be monitored in real time, and then the application may be automatically controlled according to the wearing state of the receivers. Accordingly, in the embodiments of the present disclosure, the running state of a corresponding application and the operation mode of the smart terminal device may be automatically controlled only by monitoring the actions of wearing and taking off the receivers without performing any manual control operations, so that the operations with respect to an earphone may be simplified, the lifetime of the mechanical components of the earphone may be increased, and the electric energy of the smart terminal device may be saved.

It should be understood that the descriptions both in general above and in details hereinafter are only exemplary, rather than to limit the present disclosure.

Figure 1:
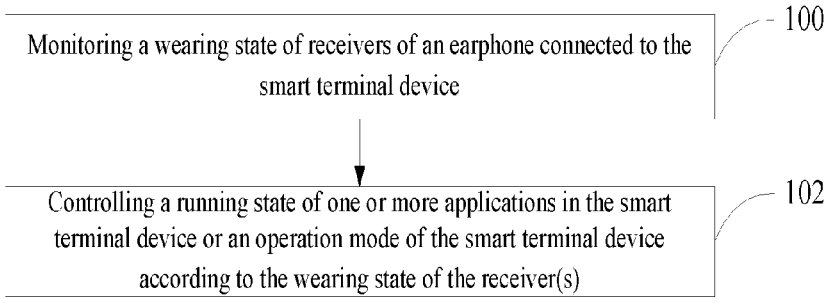
FIG. 1 is an exemplary flow chart of a method for controlling a smart terminal device according to a first embodiment of the present disclosure.

Some specific embodiments of the present disclosure are illustrated through the above mentioned drawings, followed by description in more detail hereinafter. Such drawings and description are provided to explain the concept of the present disclosure for those skilled in the art with reference to particular embodiments, rather than to limit the scope of the disclosed conception in any manner.

DESCRIPTION OF THE EMBODIMENTS

In order to clearly understand the above objects, features and advantages of the embodiments of the present disclosure, hereafter, the embodiments of the present disclosure will be described in detail with reference to the appending drawings.

According to the embodiments of the present disclosure, a smart terminal device can be automatically controlled to perform a corresponding operation according to the wearing state of receivers of an earphone connected to the smart terminal device. Thus, some cumbersome manual operations may be avoided and the lifetime of the earphone may be increased. Meanwhile, the electric energy wasted by the smart terminal device due to neglection of a manual operation may be avoided.

According to the embodiments of the present disclosure, the smart terminal device may be a smart terminal device with multimedia function, which can support audio function, video function, data processing function, and so on. For example, the smart terminal may be a mobile phone, a player or a game player, a videophone, a conference terminal, a PC with built-in multimedia function, a PDA, and so on.

Currently, when an earphone is used in the smart terminal device, if the receivers of the earphone are put on the ears or taken thereof, it is required to manually control the running state of some applications in the smart terminal device or the operation mode of the smart terminal device. However, the manual operation is very cumbersome and the frequent mechanical operations easily lead to abrasion and aging of switches, plugs and sockets of the earphones. Furthermore, if a user forgets to perform the manual operation, a mistake may occur to the running process of applications and the electric energy of the device may be wasted.

In order to solve the above problems, an embodiment of the present disclosure provides a method for controlling a smart terminal device, which can automatically control the smart terminal device to perform a corresponding operation according to various wearing states of receivers of an earphone connected to the smart terminal device.

According to the present disclosure, the smart terminal device includes one or more processors to receive various data, programs and instructions, and to process such data, programs and instructions accordingly. The smart terminal device also includes a memory which is coupled to the one or more processors and is configured to store the data, programs and instructions to be processed by the processors. Furthermore, the smart terminal device may further include input modules, such as a touch screen, a camera, a keyboard, a mouse or the like. Moreover, the smart terminal device may be connected to the earphone and transmit audio signal generated by some multimedia application to the earphone.

In the following description, the method for controlling the smart terminal device in accordance with some embodiments of the present disclosure is explained. While the process flow described below includes a plurality of steps that appear to occur in a specific order, it should be apparent that those procedures may include either fewer or more operations, which may be executed serially or in parallel.

Referring to FIG. 1, which illustrates a flow chart of a method for controlling a smart terminal device according to the first embodiment of the present disclosure. The method includes Step 100, wherein a wearing state of receivers of an earphone connected to the smart terminal device is monitored and the wearing state may include a putting-on state and a taking-off state.

According to the embodiment of the present disclosure, the earphone connected to the smart terminal device may include, but be not limited to, a wireless earphone (including a Bluetooth earphone, etc.), or a wired earphone.

According to the embodiment of the present disclosure, the smart terminal device may be controlled to perform different operations according to different wearing states of the earphone connected to the smart terminal device. Accordingly, the wearing state of the earphone connected to the smart terminal device may be firstly detected. The wearing state may include two states, i.e., the putting-on state and the taking-off state. In the putting-on state, the receivers of the earphone is worn onto the ears of the user, for example, inserted or clamped to the ears. In the taking-off state, the receivers of the earphone are taken off and removed from the ears of the user.

For the earphones (either wired or wireless) with two receivers, i.e. a left receiver and a right receiver, when at least one of the receivers is detected in the putting-on state, the earphone is deemed as being in the putting-on state; and when both of the receivers are detected taken off the ears, the earphone is deemed as being in the taking-off state. For the earphones with only one receiver, the wearing or taking-off state of the receiver indicates the wearing state of the earphone.

The method further comprises Step 102, wherein a running state of one or more applications in the smart terminal device or an operation mode of the smart terminal device is controlled according to the wearing state of the receiver(s).

According to the embodiment of the present disclosure, the running state of the one or more application in the smart terminal device or the operation mode of the smart terminal device may be controlled according to the detected wearing state of the receiver(s).

The above-mentioned application in the smart terminal device may be a rich media application including various multimedia applications and game applications, or a communication application including audio function, video function, and so on. The running state of the application may include a non-playing state and a playing state. The operation mode of the smart terminal device may include an earphone mode (e.g., wearing the receiver of the earphone when an application is running), a phone receiver mode (e.g., taking off the receivers of the earphone when a voice communication is performed), a hand-free mode (e.g., taking off the receivers of the earphone when a video communication is performed), a speaker mode (e.g., taking off the receivers of the earphone when rich media content is played), and so on.

For example, if the rich media application in the smart terminal device is in the playing state and the smart terminal device is in the speaker mode, the smart terminal device may be controlled to automatically switch to the earphone mode when the receiver of the earphone is detected to be worn by the user. That is, the user may listen to the playing rich media content through the earphone without performing a manual mode-switching operation.

It should be noted that, the term "and/or" may be interpreted having the following meaning: the embodiments of the present disclosure are not limited to the above two situations, i.e., to separately control the running state of the application in the smart terminal device and to separately controlling the operation mode of the smart terminal device. As needed, the control of the running state and the control of the operation mode may be combined according to the wearing state of the receivers. That is, the running state of the application in the smart terminal device and the operation mode of the smart terminal device may be simultaneously controlled. Hereafter, these specific cases will be discussed in detail in the following embodiments.

It should be understood that the control process is only exemplary, and the specific control process will be described in detail in the following embodiments.

In view of the above, according to the embodiments of the present disclosure, the running state of the corresponding application or the operation mode of the smart terminal device may be automatically controlled only by monitoring the actions of wearing and taking off receivers of the earphone, and no manual control operation is needed. Thus, operations needed during change of the wearing state of the receivers of the earphone may be simplified, the lifetime of the mechanical members of the earphone may be improved, and the electric energy of the smart terminal device may be saved.

In the second embodiment, the method for controlling a smart terminal device will be described below in detail.

Figure 2:
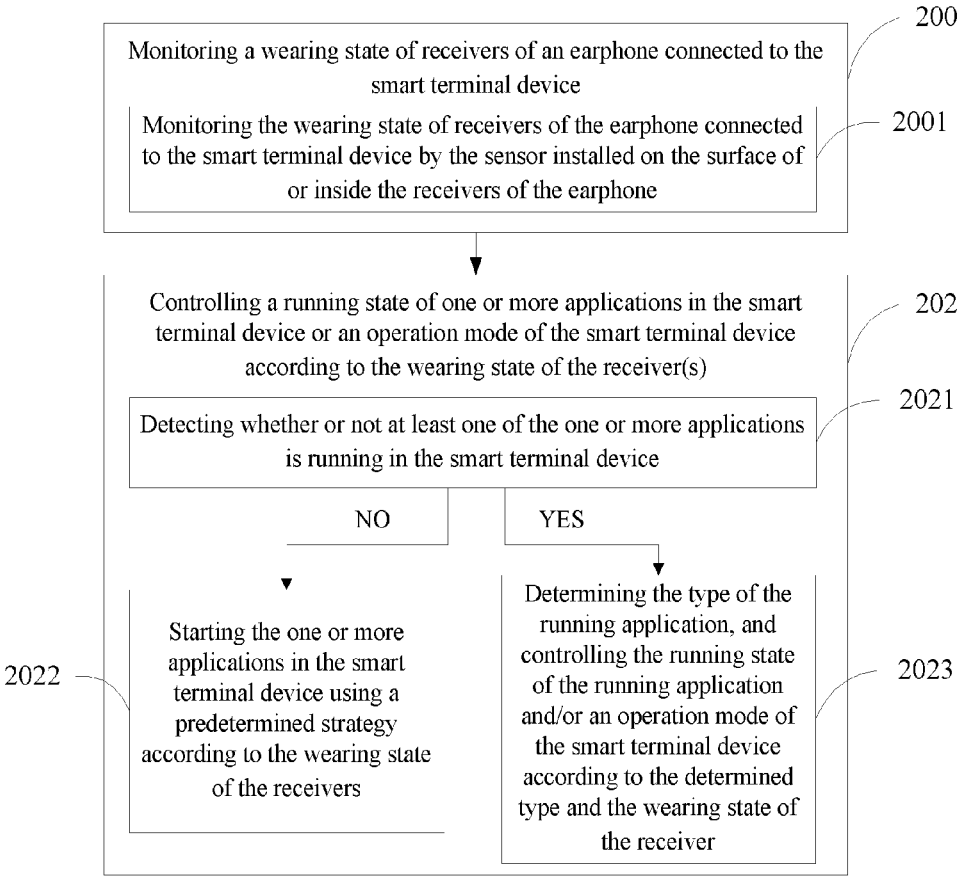
FIG. 2 is an exemplary flow chart of a method for controlling a smart terminal device according to a second embodiment of the present disclosure.

FIG. 2 illustrates a flow chart of a method for controlling a smart terminal device according to the second embodiment of the present disclosure. As shown in FIG. 2, the method includes Step 200, wherein a wearing state of receivers of an earphone connected to a smart terminal device is monitored and the wearing state including a putting-on state and a taking-off state.

According to the embodiment of the present disclosure, after analyzing the structure of the existing earphone, it can be found out that the wearing state of the earphone connected to the smart terminal device may be monitored by using a sensor disposed on the earphone.

Figure 3:
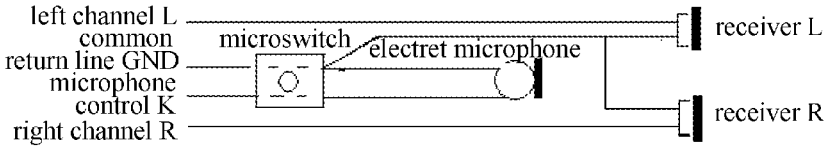
FIG. 3 is an exemplary diagram showing an internal structure of an earphone according to the prior art.

In the existing technology, a microswitch of a wired or wireless earphone is a peripheral component for controlling the play of multimedia content or game, or the implementation of communication, and so on. FIG. 3 illustrates the internal structure of a conventional earphone.

The microswitch in FIG. 3 may control the operations such as playing multimedia content, running a game, or performing communication. When a player application is paused, the terminal device may receive an instruction to switch the player application to play in response to a click on the microswitch, and vice versa. Similarly, when a communication application is running for a call communication, the device may receive an instruction to receive or hang off the call in response to the click on the micro switch. The other situations are similar to this.

However, in the prior art, the operations of playing the multimedia, game, communication can only be controlled by the microswitch of the wired or wireless earphone via manual operations. The frequent mechanical operations may possibly lead to abrasion and aging of switches, plugs and sockets of the earphone, and the manual operations are also very cumbersome.

In order to solve the above problems for the existing technologies, the embodiments of the present disclosure propose to use sensors to monitor the wearing state of receivers of the earphone in real time, thus the smart terminal device may be automatically controlled to perform operations according to various detected wearing states.

Figure 4:
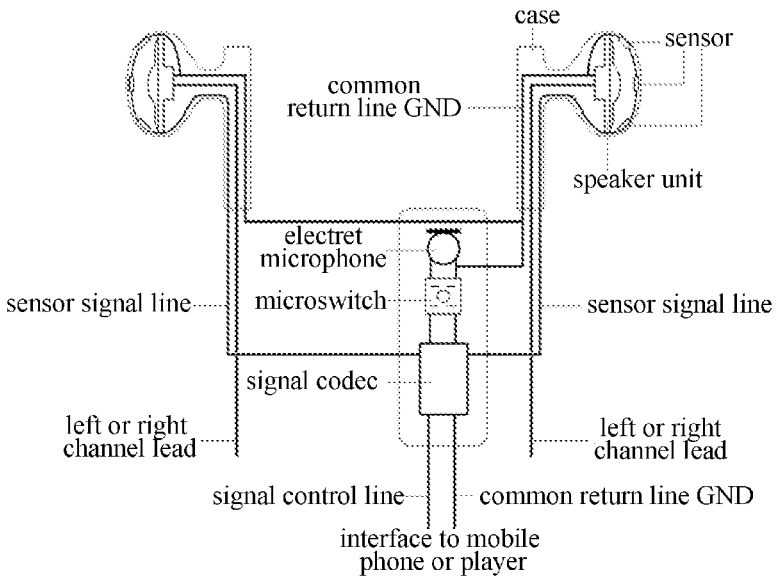
FIG. 4 is an exemplary diagram showing an internal structure of an earphone according to a second embodiment of the present disclosure.

Refer to FIG. 4, which illustrates an internal structure of the earphone according to the second embodiment of the present disclosure. As shown in FIG. 4, according to the embodiment of the present disclosure, the earphone may be provided with the sensor which can monitor the wearing state of the earphone in real time.

Therefore, step 200 may include sub-step 2001.

At sub-step 2001, the wearing state of receivers of the earphone connected to the smart terminal device is monitored by the sensor installed on the surface of or inside the receivers of the earphone.

According to the embodiment of the present disclosure, the sensor may include a camera sensor, a capacitive electrostatic sensor, a resistive pressure sensor, a piezoelectric sensor, an optical sensor, an infrared sensor, a distance sensor, or the combination thereof.

It should be understood that the sensor is not limited to the above types of sensors, and may include any other types of sensors capable of monitoring the wearing states of the receivers.

An external signal may be detected by the sensor on the surface of the receiver of the earphone or inside the receiver of the earphone, and thus the wearing state of the receivers of the earphone, i.e. whether the receiver of the earphone is worn or taken off, may be determined according to the detected signal. For example, the receiver may include an opening on the enclosure through which an optical sensor disposed inside the receiver may monitor the external light from the environment. The opening on the enclosure can be such designed that, the light can not impinge on the optical sensor through the opening when the receiver is worn by the user, and the light can impinge on the optical sensor when the receiver is taken off. Thus, the wearing state of the receivers of the earphone can be detected via the optical sensors.

For the specific operations of the sensors, one of ordinary skills in the art may perform corresponding process based on his practical experience and thus the detailed description thereof will not be elaborated in the embodiment of the present disclosure.

At Step 202, the running state of an application in the smart terminal device and/or an operation mode of the smart terminal device are controlled according to the wearing state of receivers.

According to the embodiment of the present disclosure, the running state of one or more applications in the smart terminal device and/or the operation mode of the smart terminal device may be correspondingly controlled according to different wearing states of the receivers.

Step 202 may further include sub-step 2021.

At sub-step 2021, whether or not at least one of the one or more applications is running in the smart terminal device is detected.

If no application is detected running, the process proceeds with sub-step 2022; and if one application is detected running, the process proceeds with sub-step 2023.

As shown in FIG. 4, in the embodiment of the present disclosure, a signal codec may be provided in an internal control module of the earphone. The signal codec may encode the signal detected by the sensor to generate a corresponding control instruction.

For example, after the detection of the external signal by the sensor, the signal may be transmitted to the signal codec via a sensor signal line, and then be encoded by the signal codec to generate the corresponding instruction. The instruction is transmitted to the smart terminal device to control the smart terminal device to perform a corresponding operation.

Therefore, according to the embodiment of the present disclosure, the sub-step 2021 of monitoring whether or not an application is running in the smart terminal device may include:

A1: receiving the control instruction generated by the signal codec installed in the earphone; and A2: monitoring whether one of the one or more application is running in the smart terminal device according to the control instruction.

For example, when the sensor detects an action of wearing or taking off the receiver of the earphone, the sensor transmits the detected signal to the signal codec via the sensor signal line, and the signal codec encodes the received signal to generate a control instruction. The smart terminal device may automatically monitor whether or not one application is running in the smart terminal device according to the control instruction.

In addition, according to the embodiment of the present disclosure, the signal codec may decode the instruction transmitted to the earphone by the smart terminal device, and control the sensor and other parts of or attached to the smart terminal device (e.g., earphone). For example, an instruction for adjusting the sensitivity of the sensor transmitted by the smart terminal device may be decoded, and then the sensitivity of the sensor may be adjusted according to the decoded instruction, details of which description will not be elaborated.

Regarding the functions of other parts in the earphone, one of ordinary skill in the art may perform a corresponding process according to his practical experience, details of which description will not be elaborated as well.

At sub-step 2022, the one or more applications in the smart terminal device are started using a predetermined strategy according to the wearing state of the receivers when no application is detected running.

For example, the case that no application is detected running means that indicates that the smart terminal device is in a locked state or in a sleeping state, or the smart terminal device is unlocked but any application(s) related to playing or communication is closed.

According to the embodiment of the present disclosure, some strategies of starting up the one or more applications in the smart terminal device may be preset. For example, the sub-step 2022 may include three situations as below.

A first situation: when the receiver is in the putting-on state, a desktop application in the smart terminal device may be controlled to be started and displayed.

For example, when the sensor detects that the receiver of the earphone is worn by the user, if the smart terminal device (e.g., mobile phone, player, or game machine) is in the locked and sleeping state, the signal codec may firstly generate an awakening instruction and the awakening instruction may be transmitted to the smart terminal device. Then the smart terminal device may be automatically awakened and unlocked according to the awakening instruction. After the smart terminal device is unlocked, the desktop application in the smart terminal device may be displayed for the user to select application(s) to run.

A second situation: when the receiver is in the putting-on state, the preset application in the smart terminal device may be controlled to be started and displayed.

If the predetermined strategy is to automatically run a certain application (which may be preset) when the receiver is worn, the preset application in the smart terminal device may be controlled to be started when the receiver is detected in the putting-on state.

In the embodiment of the present disclosure, the one or more applications may include a rich media application and a communication application. For example, if the application, which is preset to run when the receiver is worn, is a communication application, a control instruction may be generated when the receiver is in the putting-on state, and the smart terminal device may automatically run the communication application according to the control instruction (e.g., automatically open a contacts). For example, according to the settings by the user, when the receiver is in the putting-on state, the smart terminal device may automatically run the rich media application related to the earphone, such as a music player, a video player or a game.

A third situation: when the receiver is in the putting-on state, the display interface may be controlled to display a list of applications and an application selected by the user from the list of applications may be started. Here, the list of applications may be a list of rich media applications or a list of communication applications.

For example, the list of rich media applications may include two lists as blew.

(1) if a plurality of rich media applications are preset included in the list of rich media applications, the display interface may be controlled to display the preset list including the plurality of rich media applications and the application selected by the user from the list of rich media applications may be started.

(2) if there is no preset rich media application, according to the embodiment of the present disclosure, the smart terminal device may be automatically controlled to sort respective rich media applications according to the predetermined strategy (e.g., the frequency of use, the time of last use), display the sorted list including the plurality of rich media applications, and start the application selected by the user from the list of rich media applications.

At sub-step 2023: when one application of the one or more applications is running in the smart terminal device, the type of the running application is determined, and the running state of the running application and/or an operation mode of the smart terminal device are controlled according to the determined type and the wearing state of the receiver.

In the embodiment of the present disclosure, if one application of the one or more applications is running in the smart terminal device, the running state of the running application or the operation mode of the smart terminal device may be controlled according to the type of the application and the wearing state of the receiver.

The sub-step 2023 may include four situations as blew.

First Situation

When the running application is a rich media application and if the receiver is in the putting-on state, it may be determined whether the running application is in a first running state. If yes, the running application may be controlled to be switched from the first running state to a second running state.

According to the embodiment of the present disclosure, the first running state is an un-playing state, and the second running state is a playing state. For example, in the case that the running application is the rich media application, if it is detected that the receiver is in the putting-on state and the rich media application is in the un-playing state (e.g., a pause state), the smart terminal device may automatically switch the rich media application from the un-playing state to the playing state according to a control instruction.

It should be noted that in the putting-on state, the operation mode of the smart terminal device is set in the earphone mode by default. Thus, in the case that the running application is the rich media application, if the receiver is in the putting-on state and the running state is the second running state (i.e., the playing state), the smart terminal device may use the earphone mode. The operation mode of the smart terminal device is set in the speaker mode by default when the receivers of the earphone are in the taking-off state. If the receiver is switched from the taking-off state to the putting-on state, then the operation mode of the smart terminal device is switched to the earphone mode after the above switch.

Second Situation

In the case that the running application is a rich media application, if the wearing state of the receiver is a taking-off state, the running state of the running application may be determined. If the running state is the second running state, the running application may be controlled to be switched from the second running state to the first running state; and if the running state is the first running state, the running application may be controlled to be switched from the first running state to the second running state, and the operation mode of the smart terminal device may be controlled to be switched to the first operation mode.

For example, when the sensor detects the receiver of the earphone is in the taking-off state, if the rich media application in the smart terminal device is in the playing state, the smart terminal device receives a control instruction transmitted from the earphone so as to automatically pause the playing (that is, the running state of the rich media application is switched from the playing state to the un-playing state). If the rich media application in the smart terminal device is in the un-playing state, when the smart terminal device receives an instruction of continuing the play triggered by the user (e.g., the user controls a switch of the earphone and clicks a play button in a player interface), the running state of the smart terminal device may be switched from the un-playing state to the playing state, and the operation mode of the smart terminal device may be switched to the first operation mode (i.e., the speaker mode) so that an internal speaker in the smart terminal device may continue playing the rich media content.

Third Situation

When the running application is a communication application, if the receiver is in the putting-on state, the smart terminal device is controlled to be switched to a second operation mode. Alternatively, when the running application is a communication application, if the receiver is in the putting-on state, it may be determined whether the running state of the running application is the first running state, and if yes, the running application may be controlled to be switched from the first running state to the second running state.

In the embodiment of the present disclosure, the second operation mode may be the earphone mode. If the receiver is in the putting-on state when the communication application (an audio communication or a video communication) is running, the smart terminal device may be controlled to be switched to the earphone mode, i.e., to be used for communication via the earphone.

In addition, for certain communication application (for example, the Wechat communication), the communication content is transmitted in the form of audio clips, which may be controlled to be played or paused. In such case, if the receiver is in the putting-on state and the communication application is detected in the first running state (i.e., the un-playing state), the running application may be controlled to be switched from the first running state to the second running state (i.e., playing state) so as to continue playing the communication content. At this time, the smart terminal device may be in the earphone mode by default.

Fourth Situation

When the running application is the communication application, if the receiver is in the taking-off state, the smart terminal device may be controlled to be switched to a third operation mode. Alternatively, when the running application is the communication application, if the receiver is in the taking-off state, it may be determined whether the running application is in the second running state; and if yes, the running application may be controlled to be switched from the second running state to the first running state.

In the embodiment of the present disclosure, the third operation mode may vary according to various types of communications.

For example, when the user is wearing the earphone to receive an audio communication, if the sensor detects that the user takes off the receiver of the earphone, the smart terminal device may be automatically switched to the phone receiver mode upon receiving the control instruction from the earphone, and the user may directly put the receiver of the terminal device to the ear so as to continue the audio communication.

When the user is wearing the earphone to receive a video communication, if the sensor detects that the user takes off the receiver of the earphone, the smart terminal device may be automatically switched to the hand-free mode upon receiving the control instruction from the earphone, and the user may directly use a speaker of the terminal device to continue the video communication.

In addition, for some communication applications (e.g., the Wechat communication application), if the receiver is in the taking-off state and it is detected that the communication application is in the second running state (i.e., the playing state), the running application may be controlled to be switched from the second running state to the first running state (i.e., the un-playing state) so as to pause the playing of the information content.

It should be noted that controlling the running application to switch from the first running state to the second running state may include the following cases.

(i) when there is only one running application, the running application may be controlled to be switched from the first running state to the second running state;

(ii) when there are two or more running applications, a list of running applications may be provided to the user for selection. And an application selected from the list of running applications by the user may be controlled to be switched from the first running state to the second running state.

If there are two or more applications in the first running state, a corresponding list of running applications may be generated, so that the applications in the list may be sorted according to the predetermined strategy (e.g., last using time). And the user may switch one or more of the two or more applications from the first running state to the second running state by clicking the icon or indicator thereof.

In view of the above, the embodiment of the present disclosure provides a method for controlling a smart terminal device, which is capable of monitoring a signal via the sensor installed in the earphone, encoding the signal by the signal codec to generate the corresponding control instruction and transmitting the control instruction to the smart terminal device. Therefore, the smart terminal device may automatically control the running state of the application in the smart terminal device or the operation mode of the smart terminal device according to the control instruction without performing the cumbersome manual operation.

In the third embodiment of the present disclosure, it will be described in detail how to control the smart terminal device to perform a corresponding operation according to the wearing state of the receivers of the earphone.

The embodiment of the present disclosure is described by taking a wired earphone (with two receivers) as an example. The running application in the smart terminal device may include rich media applications and communication applications. The rich media applications may include multimedia applications and game applications, and the communication applications may include audio communication applications and video communication applications (may also include the Wechat application, which will not be elaborated with reference to the embodiment).

Figure 5:
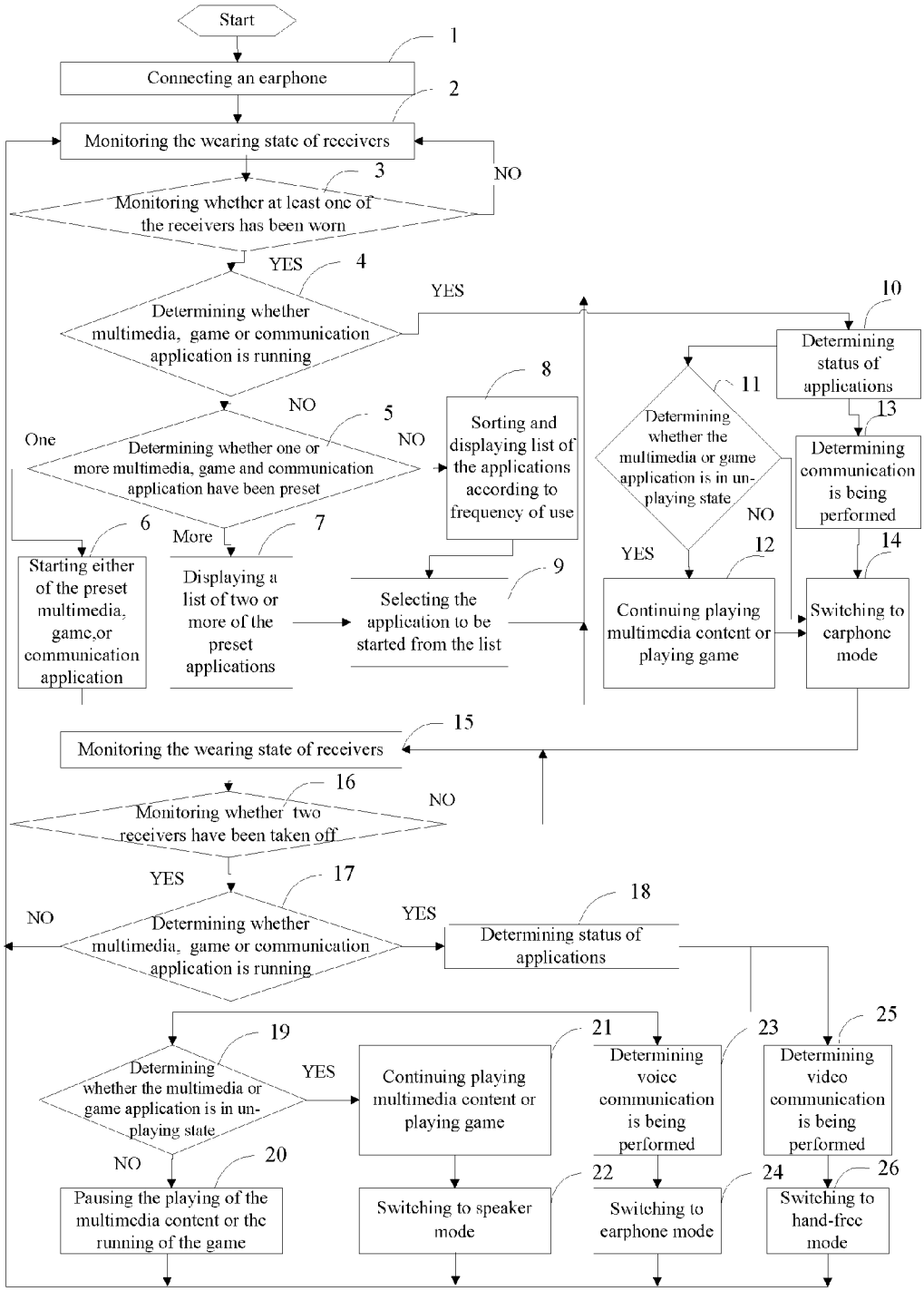
FIG. 5 is an exemplary flow chart of a method for controlling a smart terminal device according to a third embodiment of the present disclosure.

Referring to FIG. 5, a flow chart of a method of controlling a smart terminal device according to the third embodiment of the present disclosure is illustrated, which may include the following steps.

In Step 1, an earphone is connected to the smart terminal device.

In the embodiment of the present disclosure, the earphone may be connected to the smart terminal device first. For example, a wired earphone is plugged into the smart terminal device (for example, a mobile phone, a player, or a game machine), or an wireless earphone is connected to the smart terminal device.

In Step 2, the wearing state of receivers of the earphone is monitored at regular intervals.

After the earphone is connected to the smart terminal device, the smart terminal device monitors whether the user is wearing the receivers of the earphone through a sensor in the earphone.

According to the embodiment of the present disclosure, the wearing state of the receiver(s) of the earphone may be monitored by the sensor at regular intervals. The embodiment of the present disclosure doesn't limit the specific time of the intervals.

At Step 3, whether at least one of the receivers of the earphone has been worn may be monitored by the sensor.

If yes, the process proceeds with step 4; otherwise the process returns to step 2.

At Step 4, it is determined whether a multimedia application, a game application or a communication application is running in the smart terminal device.

If yes (i.e., the multimedia application, the game application or the communication application is running), the process proceeds with step 10; otherwise (i.e., no multimedia application is running to play multimedia contents, no game application is running to run a game, and no communication application is running for communication) the process proceeds with Step 5.

At Step 5, it is determined whether one or more of the multimedia application, the game application, and the communication application have been preset.

The process proceeds with Step 6 if one of the multimedia application, the game application and the communication application is preset. The process may proceed with Step 7 if more than one of the multimedia application, the game application and the communication application are preset. he process proceeds with Step 8 if none of the multimedia application, the game application and the communication application is preset.

At Step 6, the smart terminal device starts either of the preset multimedia application, the preset game application or the preset communication application.

According to the embodiment of the present disclosure, if at least one of the multimedia application, the game application or the communication application is preset, the preset application is started and then the process proceeds with Step 10 when it is detected that at least one of the receivers of the earphone has been worn while none of the multimedia application, the game application and the communication application are running.

At Step 7, the smart terminal device displays a list of two or more of the preset multimedia applications, game applications, and communication applications.

If two or more of the multimedia applications, game applications, and communication applications are preset, the smart terminal device may display the list of two or more of these preset applications, and the two or more of these preset applications may be sorted according to a predetermined strategy (e.g., the frequency of use). Thereafter, the process proceeds with Step 9, i.e., to select an application from the list according to a selection instruction generated when the user clicks on the application in the list.

At Step 8, the smart terminal device sorts and displays the list of the multimedia applications, the game applications, and the communication applications according to the frequency of use.

According to the embodiment of the present disclosure, if none of the multimedia application, the game application and the communication application is preset, the smart terminal device may automatically sort respective applications according to their frequencies of use and display the list of the sorted multimedia applications, game applications and communication applications. Then, the process proceeds with Step 9, i.e., to select the application to start from the list according to the selection instruction generated when the user clicks on the application in the list.

At Step 9: the application is selected to be started from the list according to the select instruction generated when the user clicks on the application in the list.

At Step 10: the status of the multimedia application, the game application, or the communication application is determined.

When it is determined at Step 4 that the multimedia application, the game application, or the communication application is running in the smart terminal device, the status of the multimedia application, the game application, or the communication application may be further determined and then the smart terminal device may be controlled to perform a corresponding operation according to the status of the multimedia application, the game application, the communication application.

If it is determined that the multimedia application or the game application is running, the process proceeds with Step 11; and if it is determined that the communication application is running, the process proceeds with Step 13.

At Step 11: it is determined whether the running status of the multimedia application or the game application is in the un-playing state.

If yes, the process proceeds with Step 12. And if the running status of the multimedia application or the game application is in the playing state, the process proceeds with Step 14.

At Step 12: the smart terminal device continues playing the multimedia content or playing game, and the process proceeds with Step 14.

At Step 13: it is determined that a communication is being performed, the process proceeds with Step 14.

At Step 14: the smart terminal device switches to the earphone mode, and the process proceeds with Step 15.

At Step 15: the wearing state of the receivers of the earphone is monitored at regular intervals.

At Step 16: the sensor monitors whether the two receivers have been taken off.

If yes, the process proceeds with Step 17; otherwise the process proceeds with Step 15.

At Step 17: it is determined whether the multimedia application, the game application, or the communication application is running in the smart terminal device.

If yes, (i.e., the multimedia application, the game application, or the communication application is running in the smart terminal device), the process proceeds with Step 18; and if no, (i.e., no multimedia application is running to play the multimedia content, no game application is running to run game, or no communication application is running for communication) the process returns to Step 2.

At Step 18: the status of the multimedia application, the game application, or the communication application is determined.

When it is determined at Step 17 that the multimedia application, the game application, or the communication application is running in the smart terminal device, the situation of the multimedia application, the game application, or the communication application may be further determined, and then the smart terminal device is controlled to perform an operation according to the determined status of the multimedia application, the game application, or the communication application.

If it is determined that the multimedia application or the game application is running, the process proceeds with Step 19. If it is determined that the voice communication is running, the process proceeds with Step 23; and if it is determined that the video communication is running, the process proceeds with Step 25.

At Step 19: it is determined whether the running status of the multimedia application or the game application is in the un-playing state.

If yes, the process proceeds with Step 21; and if the running status of the multimedia application or the game application is in the playing state, the process proceeds with Step 20.

At Step 20: the smart terminal device pauses the playing of the multimedia content or the running of the game, and the process returns to Step 2.

At Step 21: a play-resuming instruction is received, and the smart terminal device is controlled to resume playing the multimedia content or running the game according to the continue-play instruction.

According to the embodiment of the present disclosure, the play-resuming instruction may be generated by the user click on a play-resuming button, or may be triggered in other manners, which is not limited in the embodiment of the present disclosure.

At Step 22: the smart terminal device switches to the speaker mode, and the process returns to Step 2.

At Step 23: it is determined that the voice communication is running, and the process proceeds with Step 24.

At Step 24: the smart terminal device switches to the earphone mode, and the process returns to Step 2.

At Step 25: it is determined that the video communication is running, and the process proceeds with Step 26.

At Step 26: the smart terminal device switches to the handfree mode, and the process returns to Step 2.

Hereafter, the method for controlling a smart terminal device according to the embodiment of the present disclosure will be elaborated with reference to the following four scenarios.

First Scenario

When the sensor detects that the user is wearing the earphone, if the smart terminal device (e.g., a mobile phone, a player, or a game machine, etc.) is in the locked or sleeping state, the signal codec may firstly generate the awakening instruction and transmit the awakening instruction to the smart terminal device. The smart terminal device may be controlled to be automatically unlocked according to the awakening instruction (if there is a password on the locking screen, an input box may be popped up firstly for inputting and verificating the password). Then, the signal codec generates the wear control instruction to control the smart terminal device to automatically start the multimedia application, the game application or the communication application according to the setting preset by the user, or display the list of these applications (these applications may be sorted in the list according to the preset settings and the frequency of use so that the user may start a corresponding application by selection).

If the screen of the smart terminal device has been unlocked and no application for playing and communication is started (e.g., no multimedia application is running to play multimedia content, no game application is running to run game, and no communication application is running for communication), the signal codec generates the wear control instruction and controls the smart terminal device to perform a start operation.

The first scenario may correspond to Steps 5-9 in FIG. 5, and of which the detailed process will not be elaborated in the embodiment of the present disclosure.

Second Scenario

When the sensor detects that the user is wearing the earphone, if the smart terminal device is in a state of pausing the multimedia content (for example, music, video) or pausing a game, the smart terminal device receives the wear control instruction transmitted from the earphone to automatically resume the playing of the multimedia content or the running of the game.

The above scenario may correspond to Steps 11-12 in FIG. 5.

When the sensor detects that the user is wearing the earphone, if the smart terminal device is in a state of playing the multimedia content (for example, music, video) or running a game, the smart terminal device receives the taking-off control instruction transmitted from the earphone to automatically pause the playing of the multimedia content or the running of the game. At this time, the user may resume playing the multimedia content or running the game through a switch in the earphone or a play button on a player interface, and via an internal speaker in the smart terminal device.

The above scenario may correspond to Steps 19-22 in FIG. 5.

Additionally, if two or more of the multimedia content or games are paused, a play list may be correspondingly generated in which these multimedia content and/or games are sorted according to the last use time of the user, so that the user may resume playing the corresponding multimedia content or game by a click selection.

Third Scenario

When the user wearing the earphone is conducting an audio communication, if the sensor detects that the user takes off the earphone, the smart terminal device receives the taking-off control instruction transmitted from the earphone and then is automatically switched to the earphone mode, so that the user may resume receiving the audio communication by directly putting the receiver of the device to the ear.

The above scenario may correspond to Steps 23-24 in FIG. 5.

Fourth Scenario

When the user wearing the earphone is conducting a video communication, if the sensor detects that the user takes off the earphone, the smart terminal device receives the taking-off control instruction transmitted from the earphone and then is automatically switched to the hand-free mode, so that the user may resume performing the video communication directly via the speaker of the device.

The above scenario may correspond to Steps 25-26 in FIG. 5.

It should be understood that the present disclosure may include other scenarios. One of ordinary skills in the art may perform a corresponding process according to actual situations, which will not be further described hereinafter.

In view of the above, according to the embodiment of the present disclosure, in various emergency scenarios the user may control the running of a related application just by simply wearing and taking off the receivers of the earphone. That is, by wearing or taking off the receivers of the earphone, the device may automatically control the playing of a multimedia content, a game, and a communication and control the switch among the respective operation modes according to different scenarios. Thus, the mistake in the playing contents or the game process and the electric energy waste of the device may be avoided if the user forgets or has no time to stop the playing of the multimedia content and game due to taking off the receiver of the earphone in hurry. Meanwhile, the respective modes may be automatically switched according to different scenarios, without plugging the wired earphone or turning on/off the wireless earphone by settings. The method provided by the embodiments of the present disclosure is much more human. Not only the operations to the earphone are simplified, but also the lifetime of the mechanical members of the earphone can be improved and the electric energy of the smart terminal device can be saved.

It should be illustrated that for a brief description, the above embodiments relating to methods are expressed as a series combination of actions. However, one of ordinary skill in the art should understand the disclosure is not limited by an order of the actions described herein, while some steps may be performed in other order or simultaneously according to the present disclosure. Secondly, one of ordinary skill in the art should also understand that the embodiments described in specification are the preferred embodiments, and thus the actions involved in this disclosure are not necessarily required.

Figure 6:
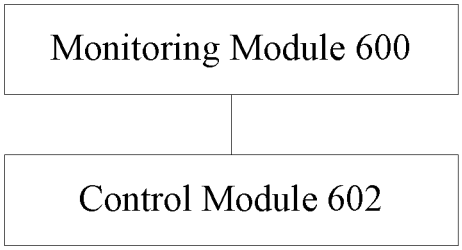
FIG. 6 is an exemplary block diagram showing a system for controlling a smart terminal device according to a fourth embodiment of the present disclosure.

Referring to FIG. 6, it illustrates a block diagram of a system for controlling a smart terminal device according to the fourth embodiment of the present disclosure, and the system may include a monitoring module 600 and a control module 602.

Herein, the monitoring module 600 may be configured to monitor a wearing state of receivers of an earphone connected to the smart terminal device, the wearing state includes a putting-on state and a taking-off state.

Herein, the detected earphone connected to the smart terminal device may be a wireless earphone or a wired earphone.

The control module 602 may be configured to control running state of one or more applications in the smart terminal device and/or an operation mode of the smart terminal device according to the wearing state of the receivers.

According to the embodiment of the present disclosure, the wearing state of the receivers of the earphone connected to the smart terminal device may be monitored in real time, and then the application may be automatically controlled according to the wearing state of the receivers. Accordingly, in the embodiment of the present disclosure, the running state of a corresponding application and the operation mode of the smart terminal device may be automatically controlled only by monitoring the actions of wearing and taking off the receivers, and no manual control operation is needed. Not only the operations to the earphone are simplified, but also the lifetime of the mechanical members of the earphone can be improved and the electric energy of the smart terminal device can be saved.

Figure 7:
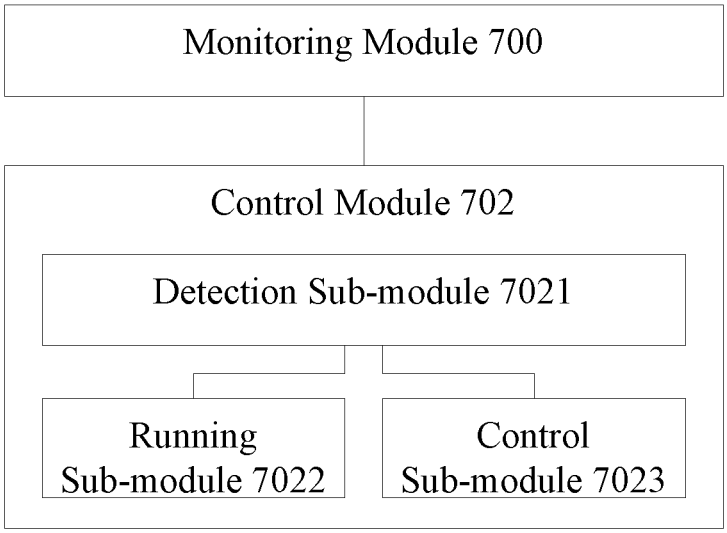
FIG. 7 is an exemplary block diagram showing a system for controlling a smart terminal device according to a fifth embodiment of the present disclosure.

Refer to FIG. 7, which illustrates a block diagram of a system for controlling a smart terminal device according to the fifth embodiment of the present disclosure, and the system may include a monitoring module 700 and a control module 702.

Herein, the monitoring module 700 may be configured to monitor a wearing state of receiver of an earphone connected to the smart terminal device, and the wearing state includes a putting-on state and a taking-off state.

In the embodiments of the present disclosure, the monitoring module may be configured to monitor the wearing state of the receivers of the earphone connected to the smart terminal device through a sensor installed on the surface of or inside the receivers of the earphone.

Herein, the sensor includes at least one of a camera sensor, a capacitive electrostatic sensor, a resistive pressure sensor, a piezoelectric sensor, an optical sensor, an infrared sensor, and a distance sensor.

The control module 702 may be configured to control running state of one or more applications in the smart terminal device and/or an operation mode of the smart terminal device according to the wearing state of the receivers.

The control module 702 may include a detection sub-module 7021, a running sub-module 7022, and a control sub-module 7023.

Herein, the detection sub-module 7021 may be configured to monitor whether or not one of the one or more applications is running in the smart terminal device.

The detection sub-module 7021 may include: a receiving sub-unit configured to receive a control instruction generated by a signal codec installed in the earphone; and a detection sub-unit configured to monitor whether or not one of the one or more application is running in the smart terminal device according to the control instruction.

The running sub-module 7022 may be configured to start an application in the smart terminal device using a predetermined strategy based on the wearing state of the receivers when the detection sub-unit detects that no application is running in the smart terminal device.

The running sub-module 7022 may include: a first application running sub-unit configured to control to the application in the smart terminal device to be started and display a desktop application when the wearing state of the receivers is the wearing stat; or a second application running sub-unit configured to control an application preset in the smart terminal device to be stated when the wearing state of the receivers is the putting-on state; and a third application running sub-unit configured to control a display interface to display a list of applications and start an application selected by the user from the list of applications when the wearing state of the receivers is the putting-on state.

The control sub-module 7023 may be configured to determine the type of the running application when an application is running in the smart terminal device, and control the running state of the running application and/or the operation mode of the smart terminal device according to the determined type and the wearing state of the receivers.

The control sub-module 7023 may include: a first rich media switch sub-unit configured, when the running application is a rich media application, to determine whether the running application is in a first running state if the wearing state of the receivers is the putting-on state; and to control the running application to switch from the first running state to a second running state if the running application is in the first running state; a second rich media switch sub-unit configured, when the running application is a rich media application, to determine the running state of the running application if the wearing state of the receivers is the taking-off state; to control the running application to switch from the second running state to the first running state if the running application is in the second running state; and to control the running application to switch from the first running state to the second running state and control the smart terminal device to switch to a first operation mode if the running application is in the first running state; a first communication switch sub-unit configured, when the running application is a communication application, to control the smart terminal device to switch to the second operation mode or determine whether the running state is in the first running state if the wearing state of the receivers is the putting-on state; and to control the running application to switch from the first running state to the second running state if the running application is in the first running state; and a second communication switch sub-unit configured, when the running application is a communication application, to control the smart terminal device to switch to a third operation mode or determine whether the running state is in the second running state if the wearing state of the receivers is the taking-off state; and to control the running application to switch from the second running state to the first running state if the running application is in the second running state.

The embodiment of the present disclosure may apply to any form of wired earphone or wireless earphone, for example, an earbud earphone, an insert type earphone, a headphone, a circumaural earphone, and so on. By adding a sensor or several sensors on the surface of the earphone or inside the earphone, the smart terminal device may monitor whether the user is wearing the receivers of the earphone through the sensor; and then, for different scenarios, the running of an application and the operation mode may be controlled to be switched merely by wearing or taking off the receivers of the earphone, thereby simplifying the operations.

Since the embodiments of the system are similar with the embodiments of the method, the description thereof is simplified and the same part may refer to the embodiment of the method.

It should be noted that in the embodiments of the present disclosure, a signal generated when the sensor detects that the user wears and takes off the receivers of the earphone may be converted into an encoded instruction to be transmitted to the smart terminal device by the signal codec. Then, a corresponding control may be performed according to the current specific situation of the smart terminal device, while the common earphone interaction operation is still followed during the whole process when the user wears or takes off the receivers of the earphone.

In this specification, the respective embodiments are described in a progressive manner, and each of the embodiments describes a focus different from that of the other embodiment. Thus, the same parts between the respective embodiments may refer to each other.

It can be understood by those skilled in the art that, the modules in the smart terminal device of the embodiment may be distributed in the apparatus according to the description of the embodiments, or may vary to be contained in one or more apparatus other than that of this embodiment. The modules in the above embodiments may be combined as one module, or may be further divided into several sub-modules.

Through the above description to the embodiments, it can be clearly understood by those skilled in the art that, the embodiments of the present disclosure may be implemented by hardware, or by software working with necessary common hardware platform. Based on this understanding, the technical solution of the embodiments of the present disclosure may be embodied in a form of software product which may be stored in a non-transitory storage medium (such as CD-ROM, flash disk, or mobile hard disk, etc.) and which may include a series of instructions to enable the smart terminal device to implement the methods described in the embodiments of the present disclosure.

The non-transitory computer readable storage medium may use, for example, computer software, hardware, or some combination thereof. For a hardware implementation, the embodiments described herein may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a selective combination thereof.

For a software implementation, the embodiments described herein may be implemented with separate software modules, such as procedures and functions, each of which perform one or more of the functions and operations described herein. The software codes can be implemented with a software application written in any suitable programming language and may be stored in memory of the terminal device.

The aforementioned methods can be implemented in a non-transitory computer readable storage medium recording computer-readable codes. The non-transitory computer readable storage medium includes all kinds of recording devices in which data readable by a computer system are stored. The non-transitory computer readable storage medium includes ROM, RAM, CD-ROM, magnetic tapes, floppy discs, optical data storage devices, and the like, as well as carrier-wave type implementations (e.g., transmission via Internet).

Finally, it should be noted that the terms herein representing relationships such as first and second is only used to distinguish an entity or operation from another entity or operation, but do not necessarily require or imply these entities or operation existing in the actual relationship or order. Moreover, the term "comprising", "including" or any other variants thereof are intended to cover a non-exclusive inclusion, such that the process, method, product or device including a number of elements not only include these elements, but also other elements not explicitly listed, or but also inherent elements for the process, method, product or device. Unless otherwise restricted, the elements defined by the statement "comprise a . . . " does not exclude other elements included in the process, method, product or device including the said elements.

The method for controlling a smart terminal device and system thereof provided by the present disclosure are described in detail above, and the principle and embodiments of the present disclosure are explained by some specific examples. However, the above description of the embodiments is only used to help understand the method and its heart of the present disclosure; Meanwhile, one of ordinary skill in the art may make any modification in the specific embodiments and application scope, according to the concept of the present disclosure, and thus the contents disclosed in the specification should be not construed as limiting the present disclosure.

What is claimed is:

1. A method for controlling a smart terminal device, comprising:

periodically monitoring a wearing state of receivers of an earphone connected to the smart terminal device, wherein the wearing state comprises a putting-on state and a taking-off state;

detecting whether at least one sound releasing application is running in a background of the smart terminal device when the putting-on state is monitored, the at least one sound releasing application being selected from a group consisting of a multimedia application, a game application and a communication application;

presenting one of the sound releasing applications into an interface of the smart terminal device according to a predetermined strategy in response to detecting that no at least one sound releasing application is running in a background of the smart terminal device when the putting-on state is monitored;

determining a type of the presented application belong to which one of a multimedia application type, a game application type and a communication application type; and controlling a running state of the presented application in the smart terminal device and an operation mode of the smart terminal device according to the type of the presented application and the wearing state of the receivers, wherein the operation mode of the smart phone device comprises an earphone mode, a phone receiver mode, a hand-free mode, and a speaker mode.

2. The method according to claim 1, wherein the step of presenting one of the sound releasing applications into an interface of the smart terminal device according to a predetermined strategy comprises:

controlling a display interface to display a list of sound releasing applications including multimedia applications, game applications and communication applications; and presenting one sound releasing application selected by a user from the list of sound releasing applications.

3. The method according to claim 1, wherein the step of controlling the running state of the presented application and the operation mode of the smart terminal device according to the type of the presented application and the wearing state of the receivers comprises:

when the type of the presented application is the multimedia application type or the game application type, determining whether the presented application is in a first running state if the wearing state of the receivers is the putting-on state, and controlling the presented application to switch from the first running state to a second running state if the presented application is in the first running state;

when the type of the presented application belongs to the multimedia application type or the game application type, determining the running state of the presented application if the wearing state of the receivers is the taking-off state, and controlling the presented application to switch from the second running state to the first running state if the presented application is in the second running state, or controlling the presented application to switch from the first running state to the second running state and controlling the smart terminal device to switch to a first operation mode if the presented application is in the first running state;

when the type of the presented application is the communication application type and the wearing state of the receivers is the putting-on state, controlling the smart terminal device to switch to the second operation mode; or determining whether the presented application is in the first running state, and controlling the presented application to switch from the first running state to the second running state if the presented application is in the first running state; and when the type of the presented application is the communication application type and the wearing state of the receivers is the taking-off state, controlling the smart terminal device to switch to a third operation mode; or determining whether the running state is in the second running state, and controlling the presented application to switch from the second running state to the first running state if the presented application is in the second running state.

4. The method according to claim 1, wherein the step of periodically monitoring the wearing state of receivers of the earphone connected to the smart terminal device comprises:

periodically monitoring the wearing state of the receivers of the earphone connected to the smart terminal device through a sensor installed on the surface of or inside the receivers of the earphone;

wherein the sensor comprises at least one of a camera sensor, a capacitive electrostatic sensor, a resistive pressure sensor, a piezoelectric sensor, an optical sensor, an infrared sensor, and a distance sensor.

5. The method according to claim 1, wherein the step of detecting whether at least one sound releasing application is running in the background of the smart terminal device comprises:

receiving a control instruction generated by a signal codec installed in the earphone; and detecting whether at least one sound releasing application is running in the background of the smart terminal device upon receiving the control instruction.

6. A smart terminal device, comprising:

one or more processors; and a memory for storing instructions executable by the processor;

wherein the one or more processors are configured to perform:

periodically monitoring a wearing state of receivers of an earphone connected to the smart terminal device, wherein the wearing state comprises a putting-on state and a taking-off state;

detecting whether at least one sound releasing application is running in a background of the smart terminal device when the putting-on state is monitored, the at least one sound releasing application being selected from a group consisting of a multimedia application, a game application and a communication application;

presenting one of the sound releasing applications into an interface of the smart terminal device according to a predetermined strategy in response to detecting that no at least one sound releasing application is running in a background of the smart terminal device when the putting-on state is monitored;

determining a type of the presented application belong to which one of a multimedia application type, a game application type and a communication application type; and controlling a running state of the presented application in the smart terminal device and an operation mode of the smart terminal device according to the type of the presented application and the wearing state of the receivers, wherein the operation mode of the smart phone device comprises an earphone mode, a phone receiver mode, a hand-free mode, and a speaker mode.

7. The device according to claim 6, wherein the step of presenting one of the sound releasing applications into an interface of the smart terminal device according to a predetermined strategy comprises:

controlling display interface to display a list of sound releasing applications including multimedia applications, game applications and communication applications; and presenting one sound releasing application selected by a user from the list sound releasing of the applications.

8. The device according to claim 6, wherein the step of controlling the running state of the presented application and the operation mode of the smart terminal device according to the type of the presented application and the wearing state of the receivers comprises:

when the type of the presented application is the multimedia application type or the game application type, determining whether the presented application is in a first running state if the wearing state of the receivers is the putting-on state, and controlling the presented application to switch from the first running state to a second running state if the presented application is in the first running state;

when the type of the presented application belongs to the multimedia application type or the game application type, determining the running state of the presented application if the wearing state of the receivers is the taking-off state: and controlling the presented application to switch from the second running state to the first running state if the presented application is in the second running state, or controlling the presented application to switch from the first running state to the second running state and controlling the smart terminal device to switch to a first operation mode if the presented application is in the first running state;

when the type of the presented application is the communication application type and the wearing state of the receivers is the putting-on state, controlling the smart terminal device to switch to the second operation mode; or determining whether the presented application is in the first running state, and controlling the presented application to switch from the first running state to the second running state if the presented application is in the first running state; and when the type of the presented application is the communication application type and the wearing state of the receivers is the taking-off state, controlling the smart terminal device to switch to a third operation mode; or determining whether the running state is in the second running state, and controlling the presented application to switch from the second running state to the first running state if the presented application is in the second running state.

9. The device according to claim 6, wherein the step of periodically monitoring the wearing state of receivers of the earphone connected to the smart terminal device comprises:

periodically monitoring the wearing states of the receivers of the earphone connected to the smart terminal device through a sensor installed on the surface of or inside the receivers of the earphone;

wherein the sensor comprises at least one of a camera sensor, a capacitive electrostatic sensor, a resistive pressure sensor, a piezoelectric sensor, an optical sensor, an infrared sensor, and a distance sensor.

10. The device according to claim 6, wherein the step of detecting whether at least one sound releasing application is running in the background of the smart terminal device comprises:

receiving a control instruction generated by a signal codec installed in the earphone; and detecting whether at least one sound releasing application is running in the background of the smart terminal device upon receiving the control instruction.

11. A non-transitory computer readable storage medium having stored therein instructions that, when executed by a processor of a smart terminal device, causes the smart terminal device to perform:

periodically monitoring a wearing state of receivers of an earphone connected to the smart terminal device, wherein the wearing state comprises a putting-on state and a taking-off state;

detecting whether at least one sound releasing application is running in a background of the smart terminal device when the putting-on state is monitored, the at least one sound releasing application being selected from a group consisting of a multimedia application, a game application and a communication application;

presenting one of the sound releasing applications into an interface of the smart terminal device according to a predetermined strategy in response to detecting that no sound releasing application is running in the background of the smart terminal device;

determining a type of the presented application belong to which one of a multimedia application type, a game application type and a communication application type; and controlling a running state of the presented application in the smart terminal device and an operation mode of the smart terminal device according to the type of the presented application and the wearing state of the receivers, wherein the operation mode of the smart phone device comprises an earphone mode, a phone receiver mode, a hand-free mode, and a speaker mode.

* * * * *